US009163436B2

(12) United States Patent
Nagata et al.

(10) Patent No.: US 9,163,436 B2
(45) Date of Patent: Oct. 20, 2015

(54) DOOR OUTER HANDLE APPARATUS FOR VEHICLE

(75) Inventors: Koichi Nagata, Chiryu (JP); Nobukazu Araki, Hekinan (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 33 days.

(21) Appl. No.: 14/126,052

(22) PCT Filed: Jun. 4, 2012

(86) PCT No.: PCT/JP2012/064373

§ 371 (c)(1),
(2), (4) Date: Dec. 13, 2013

(87) PCT Pub. No.: WO2013/005519

PCT Pub. Date: Jan. 10, 2013

(65) Prior Publication Data

US 2014/0138962 A1 May 22, 2014

(30) Foreign Application Priority Data

Jul. 6, 2011 (JP) ..... 2011-150055

(51) Int. Cl.
*E05B 3/00* (2006.01)
*E05B 85/10* (2014.01)
(Continued)

(52) U.S. Cl.
CPC ..... *E05B 85/10* (2013.01); *E05B 77/06* (2013.01); *E05B 85/16* (2013.01); *Y10T 292/57* (2015.04)

(58) Field of Classification Search
USPC ..... 292/336.3, 347, DIG. 22
See application file for complete search history.

(56) References Cited

U.S. PATENT DOCUMENTS 3,719,248 A * 3/1973 Breitschwerdt et al. ..... 180/271
6,042,159 A * 3/2000 Spitzley et al. ..... 292/216
(Continued)

FOREIGN PATENT DOCUMENTS

DE 34 02 914 A1 8/1985
DE 20 2008 012949 U1 3/2010
(Continued)

OTHER PUBLICATIONS

English language translation of International Preliminary Report on Patentability (PCT/IB/373) issued by the International Bureau on Jan. 7, 2014 in International Application No. PCT/JP2012/064373 and English language translation of International Preliminary Report on Patentability. (8 pgs).
(Continued)

*Primary Examiner* — Mark Williams
(74) *Attorney, Agent, or Firm* — Buchanan Ingersoll & Rooney PC

(57) ABSTRACT

A door-opened-prevention mechanism comprises a lever member, and a biasing member biasing the lever member toward a set position. The lever member is assembled to a connection lever. The lever member is movable between the set position and a fallback position which is in a vehicle outer direction to the set position. When an inertia force, exerted on an outer handle toward the vehicle outer direction at the time of vehicle impact, is not exerted on the outer handle, the lever member is kept in the set position to enable a necessary and sufficient movement of the connection lever in a direction for opening a door, and when the inertia force is exerted on the outer handle, the lever member moves to the fallback position prior to movement of the outer handle for opening the door so as not to enable the necessary and sufficient movement of the connection lever.

9 Claims, 7 Drawing Sheets

(51) Int. Cl.
*E05B 77/06* (2014.01)
*E05B 85/16* (2014.01)

(56) References Cited

U.S. PATENT DOCUMENTS

| | | | | |
|---|---|---|---|---|
| 7,478,848 | B2 * | 1/2009 | Kim | 292/336.3 |
| 2005/0012345 | A1 | 1/2005 | Saitoh | |
| 2012/0074718 | A1 | 3/2012 | Nagata et al. | |

FOREIGN PATENT DOCUMENTS

| | | | |
|---|---|---|---|
| FR | 2 918 693 | A1 | 1/2009 |
| FR | 2 944 547 | A1 | 10/2010 |
| JP | 2008-248634 | A | 10/2008 |
| JP | 2009-243101 | A | 10/2009 |
| JP | 4397704 | B2 | 1/2010 |
| JP | 2010-133101 | A | 6/2010 |
| WO | 2011/072210 | A1 | 6/2011 |

OTHER PUBLICATIONS

European Search Report issued May 16, 2014 by the European Patent Office in corresponding European Patent Application No. 12807793.0 (7 pages).

International Search Report (PCT/ISA/210) mailed on Sep. 4, 2012, by the Japanese Patent Office as the International Searching Authority for International Application No. PCT/JP2012/064373.

Written Opinion (PCT/ISA/237) mailed on Sep. 4, 2012, by the Japanese Patent Office as the International Searching Authority for International Application No. PCT/JP2012/064373.

* cited by examiner

DOOR OUTER HANDLE APPARATUS FOR VEHICLE

TECHNICAL FIELD

The present invention relates to a door outer handle apparatus for a vehicle, particularly a door outer handle apparatus comprising a base member fixed to a door of the vehicle; an outer handle provided on the base member swingably relative to the base member in an inner and outer direction of the vehicle, the outer handle being movable between a door closed position and a door open position which is in an outer direction of the vehicle to the door closed position; a linkage mechanism capable of transmitting a movement of the outer handle for opening the door, that is a movement of the outer handle from the door closed position to the door open position, to a door latch mechanism as an unlatch operation of the latch mechanism; and a door-opened-prevention mechanism preventing the door from being opened due to inertia force exerted on structural members including the outer handle toward the outer direction of the vehicle at the time of impact of the vehicle.

In a case in which the above-described door-opened-prevention mechanism is not provided with, when an inertia force is exerted on the outer handle toward the outer direction of the vehicle at the time of impact of the vehicle, the movement of the outer handle for opening the door may arises due to this inertia force and therefore the unlatch operation of the door latch mechanism may arises. The unlatch operation of the door latch mechanism is an operation in which a state of the door latch mechanism is changed from a latch state to an unlatch state. In the latch state of the door latch mechanism, it is impossible to open the door that is closed by use of a force in the outer direction of the vehicle. In the unlatch state of the door latch mechanism, it is possible to open the door that is closed by use of the force in the outer direction of the vehicle.

BACKGROUND ART

Such a type of the door outer handle apparatus is disclosed in, for example, the Patent Document 1 described below. In the Patent Document 1, the door-opened-prevention mechanism comprises inertia stopper member (lever member) provided on the base member so as to be rotatable between a set rotational position (initial position) and a lock rotational position which is in the outer direction of the vehicle to the set rotational position; and a biasing member biasing the inertia stopper member toward the set rotational position. In the door outer handle apparatus disclosed in the Patent Document 1, when the inertia stopper member rotates from the set rotational position to the lock rotational position, which is in the outer direction of the vehicle to the set rotational position, against the biasing force of the biasing member in a case where an inertia force (a force toward the outer direction of the vehicle) is exerted on the inertia stopper member at the time of impact of the vehicle, a part of the inertia stopper member moves within a movement locus in a direction for opening the door of a structural member of the linkage mechanism (connection clip provided on a connection rod), and therefore a movement of the linkage mechanism in a direction for opening the door is restricted by the inertia stopper member. With this, at the time of impact of the vehicle, the door-opened-prevention mechanism restricts the movement of the outer handle for opening the door by use of inertia force that works toward the outer direction of the vehicle, so as to prevent the door from being opened.

PRIOR ART DOCUMENT

Patent Document

[Patent Document 1] Japanese Patent Application Laid-Open (kokai) No. 2009-243101

In the door outer handle apparatus for a vehicle disclosed in the above-described Patent Document 1, while the inertia stopper member is kept to be at the set rotational position by use of the biasing force of the biasing member (in normal condition), the inertia stopper member is outside the movement locus in the direction for opening the door of the structural member, and therefore the movement of the linkage mechanism in a direction for opening the door is permitted. Accordingly, in the normal condition, the movement of the outer handle for opening the door is able to be transmitted to the door latch mechanism as the unlatch operation of the latch mechanism through the linkage mechanism, and therefore the door is able to be opened by the movement of the outer handle for opening the door.

SUMMARY OF THE INVENTION

Problems to be Solved by the Invention

In the door outer handle apparatus for a vehicle disclosed in the above-described Patent Document 1, at the time of impact of the vehicle, the door is prevented from being opened with the above-described operations of the door-opened-prevention mechanism. However, at the time of impact of the vehicle, in a case where, the door is deformed so that the base member, the outer handle, and the linkage mechanism or the like move closer in a width direction of the vehicle and downward relative to the door latch mechanism, the movements of the base member, the outer handle, and the linkage mechanism or the like due to the deformation of the door may raise an operation for opening the door in the linkage mechanism and therefore the door may be opened due to a force toward the outer direction of the vehicle.

Means of Solving the Problems, and Action and Effect of the Present Invention The present invention is to solve the above problems. The present invention comprise: a base member fixed to a door of the vehicle; an outer handle provided on the base member swingably relative to the base member in an inner and outer direction of the vehicle, the outer handle being movable between a door closed position and a door open position which is in an outer direction of the vehicle to the door closed position; a linkage mechanism capable of transmitting a movement of the outer handle for opening the door, that is a movement of the outer handle from the door closed position to the door open position, to a door latch mechanism as an unlatch operation of the latch mechanism; and a door-opened-prevention mechanism not enabling a movement of a transmitting member (a structural member) of the linkage mechanism in a direction for opening the door, in response to the movement of the outer handle for opening the door due to inertia force exerted on the outer handle toward the outer direction of the vehicle at the time of impact of the vehicle, to be transmitted to a transmitted member (another structural member) of the linkage mechanism, so as to prevent the door from being opened. A feature of the present invention lies in that the door-opened-prevention mechanism comprises: a lever member assembled to the transmitting member above the transmitted member, the lever member being movable between a set position and a fallback position which is in the outer direction of the vehicle to the set position; and a biasing member biasing the lever member toward the set position, wherein when the inertia force is not exerted on the outer handle, the lever member is kept to be in the set position so as to enable the necessary and sufficient movement of the transmitting member in the direction for opening the door in response to the movement of the outer handle for opening the door to be transmitted to the transmitted member via the lever member, and when the inertia force is exerted on the outer handle, the lever member moves to the fallback position from the set position against the biasing force of the biasing member prior to the movement of the outer handle for opening the door so as not to enable the necessary and sufficient movement of the transmitting member in the direction for opening the door in response to the movement of the outer handle for opening the door to be transmitted to the transmitted member via the lever member.

According to the above-described door outer handle apparatus of the present invention, in the formal condition (specifically, a condition in which the inertia force is not exerted), the lever member of the door-opened-prevention mechanism is kept to be in the set position so as to enable the necessary and sufficient movement of the transmitting member in the direction for opening the door in response to the movement of the outer handle for opening the door to be transmitted to the transmitted member via the lever member. Therefore, the movement of the outer handle for opening the door is able to be transmitted to the door latch mechanism as the unlatch operation of the latch mechanism through the linkage mechanism, and therefore the door is able to be opened by the movement of the outer handle for opening the door.

At the time of impact of the vehicle (specifically, a condition in which the inertia force is exerted), the lever member moves to the fallback position from the set position against the biasing force of the biasing member due to the inertia force prior to the movement of the outer handle for opening the door so as not to enable the necessary and sufficient movement of the transmitting member in the direction for opening the door in response to the movement of the outer handle for opening the door to be transmitted to the transmitted member via the lever member. According to this, at the time of impact of the vehicle, even if the movement of the outer handle for opening the door may arises due to the inertia force, a necessary and sufficient movement of the linkage mechanism is not transmitted to the latch mechanism, and therefore the unlatch operation of the latch mechanism (an operation in which a state of the door latch mechanism is changed from a state in which the door is kept to be closed (latch state) to a state in which the door may be opened (unlatch state)) is prevented from arising.

According to the above-described door outer handle apparatus of the present invention, at the time of impact of the vehicle, the lever member, that is assembled to the transmitting member above the transmitted member, moves to the fallback position from the set position against the biasing force of the biasing member due to the inertia force prior to the movement of the outer handle for opening the door. Therefore, a space for the transmitted member to escape (a space for allowing the transmitting member to move freely downward relative to the transmitted member) is formed above the transmitted member. Accordingly, even in the case where, the door is deformed so that the base member, the outer handle, and the linkage mechanism or the like move closer in a width direction of the vehicle and downward relative to the door latch mechanism, the transmitted member is able to move freely relative to the transmitting member within the space for the transmitted member to escape (is able to remain at an initial position of the transmitted member). Therefore, the movements of the base member, the outer handle, and the linkage mechanism or the like due to the deformation of the door is not capable of raising a necessary and sufficient operation for opening the door in the linkage mechanism and therefore the door is prevented from being opened.

In a practice of the present invention, the transmitting member may be a connection lever extending inside the door in an upper and lower direction of the vehicle, and being tiltable in a width direction of the vehicle, a movement of the connection lever in a lower direction of the vehicle corresponds to the movement of the transmitting member in the direction for opening the door. In this case, the lever member and the biasing member are able to be assembled to the connection lever by use of a case accommodating the lever member and the biasing member. In this case, the lever member and the biasing member may be preliminarily assembled to the case to make them a sub-assembly. Accordingly, an ease for assembling the lever member and the biasing member or the like to the connection lever can be obtained in a good manner.

In a practice of the present invention, the lever member may have a corner portion located at an inner side of the vehicle and at a side close to the transmitted member where a first and a second cutouts are formed, the first cutout forming a space for accommodating the transmitted member in collaboration with the transmitting member and enabling the movement of the transmitting member in the direction for opening the door to be transmitted to the transmitted member in a direction perpendicular to a biasing direction of the biasing member when the lever member is in the set position, and the second cutout preventing the lever member from engaging with the transmitted member when the lever member moves to the fallback position to form a space for the transmitted member to escape. In this case, when the lever member is at the set position, the first cutout is capable of ensuring a desired function of transmitting, and when the lever member moves from the set position to the fallback position, the second cutout is capable of preventing the lever member from engaging (interfering) with the transmitted member to ensure a favorable performance for the transmitted member to escape.

MODES FOR CARRYING OUT THE INVENTION

Figure 1:
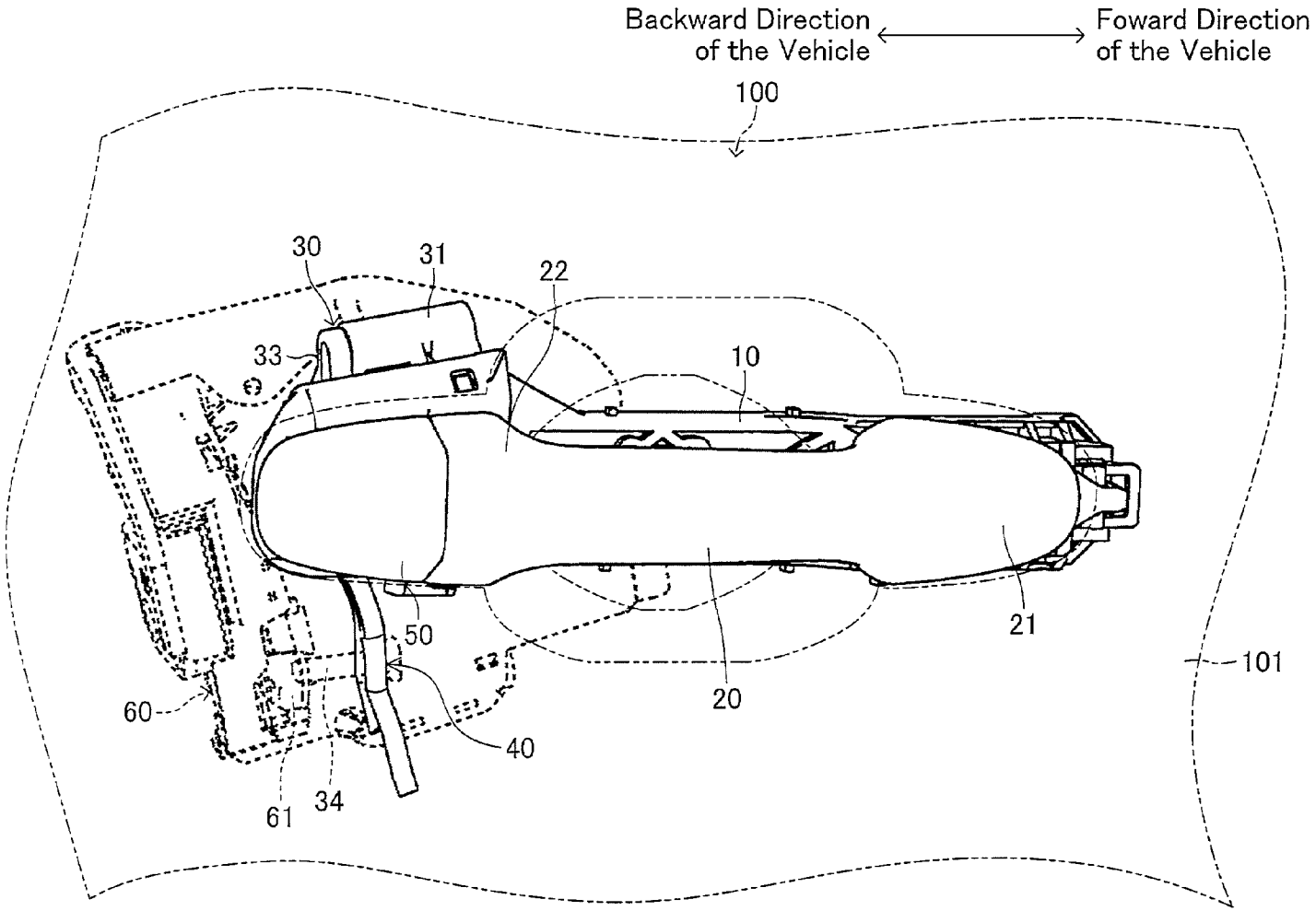
FIG. 1 is a partially perspective view from the outside of a vehicle showing an embodiment of a door for a vehicle including a door outer handle apparatus for a vehicle according to the present invention.
Figure 2:
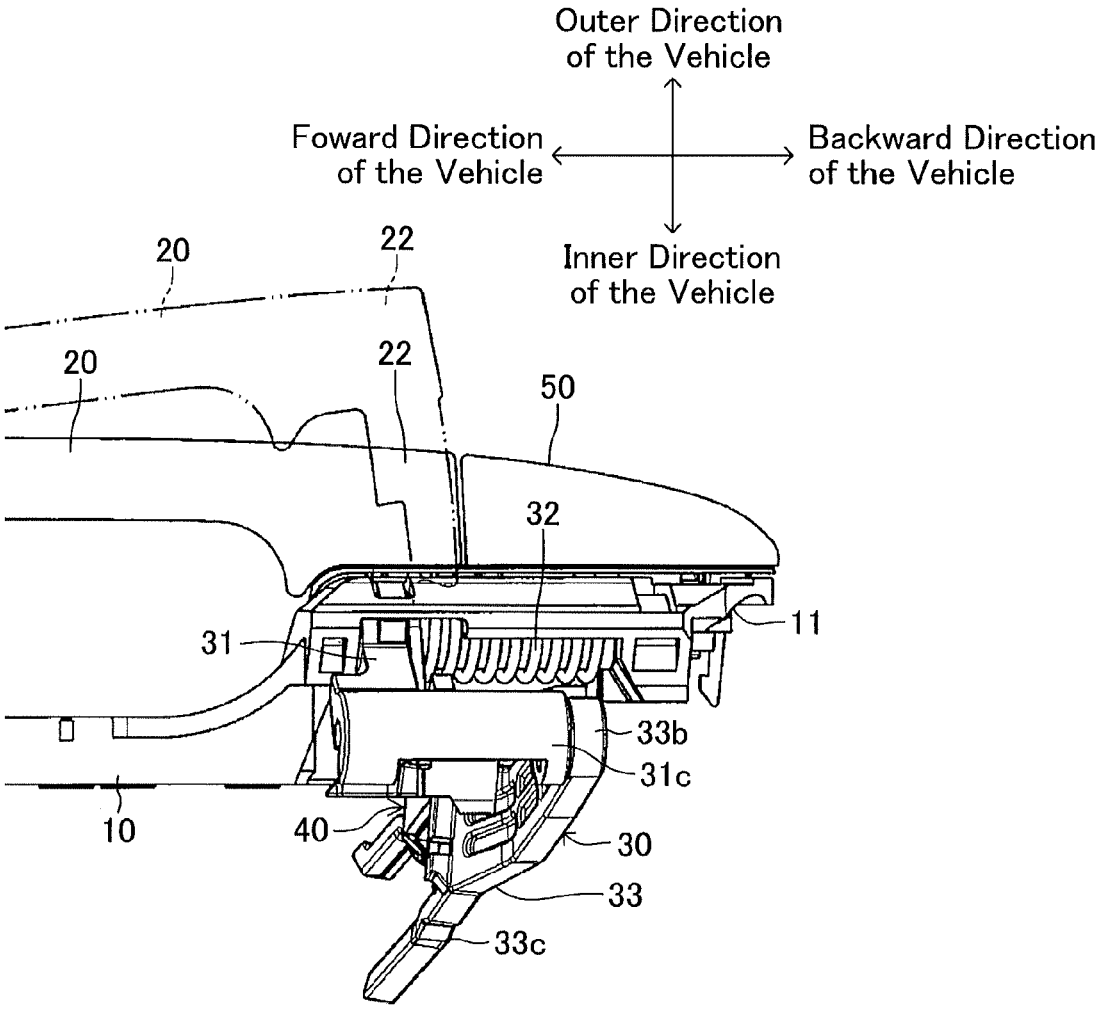
FIG. 2 is a top view showing a set state of main structural members of the door outer handle apparatus for a vehicle shown in FIG. 1.
Figure 3:
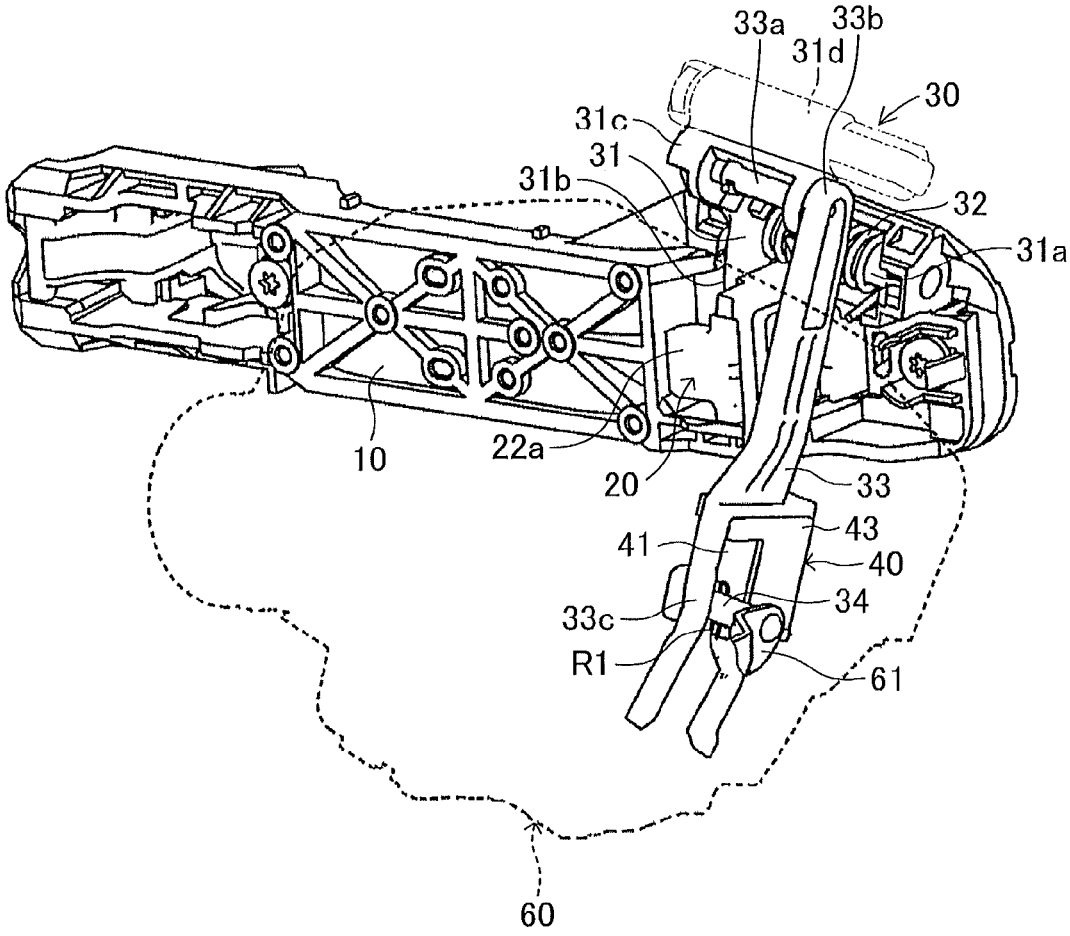
FIG. 3 is a perspective view from inside of the door showing the main structural members shown in FIG. 2.

An embodiment according to the present invention will next be described with reference to the drawings. FIGS. 1 to 9 show an embodiment of a door for a vehicle provided with a door outer handle apparatus for a vehicle according to the present invention. In this door outer handle apparatus of the embodiment, as shown in FIG. 1, s base member 10 is fixed to a door 100 assembled to the vehicle at rear and right side. As shown in FIGS. 2 and 3, an outer handle 20, a linkage mechanism 30, and a door-opened-prevention mechanism 40 or the like are assembled to the base member 10. The base member 10 is fixed to an inside of an outer panel 101 of the door 100 (see FIG. 4). A cap 50 (a member for retaining the outer handle 20 relative to the base member 10) is assembled to a rear end portion 11 of the base member 10 so as to sandwich the outer panel 101 between the base member 10 and the cap 50 (see FIGS. 1 and 2).

The outer handle 20 is a grip-shaped handle provided on the base member 10 in an almost horizontal manner, swingably relative to the base member 10 in an inner and outer direction of the vehicle (a width direction of the vehicle). The outer handle 20 is assembled to the base member 10 in a state in which the outer panel 101 is sandwiched between the base member 10 and the outer handle 20 (in a state in which the outer handle 20 is positioned outside the outer panel 101 and a part of the outer handle 20 penetrates the outer panel 101). The outer handle 20 is configured to be movable (able to be manipulated) between a door closed position (a position shown by a solid line in FIG. 2) and a door open position (a position shown by a dashed-two dotted line) which is in an outer direction of the vehicle to the door closed position. The outer handle 20 is assembled swingably to the base member 10 at a front end portion 21 of the outer handle 20 of the vehicle. A rear end portion 22 of the outer handle 20 is movable by a predetermined amount in the outer direction of the vehicle toward the position shown by the dashed-two dotted line from the position shown by the solid line. At the rear end portion 22 of the outer handle 20, an L-shaped engaging portion 22*a* (see FIGS. 3 and 4) is formed which engages with a bell crank 31 that is a structural member of the linkage mechanism 30. Notably, when the outer handle 20 is in the door closed position, upper and lower end portions of the outer handle 20 is engaged (contacted) with the outer panel 101 via a cushion 102.

The linkage mechanism 30 is configured to be able to transmit a movement of the outer handle 20 for opening the door in an outer direction of the vehicle, that is a movement of the outer handle 20 from the door closed position to the door open position, to a door latch mechanism that is contained in the door lock apparatus 60 shown in FIGS. 1 and 3 by broken lines as an unlatch operation of the latch mechanism (an operation shifting a state of the latch mechanism from a latch state to an unlatch state). The linkage mechanism 30 comprises the above-mentioned bell crank 31, a coil spring 32 and a connection lever 33. Notably, the door latch mechanism, that is of a well-known type, comprises a striker fixed to a side of a vehicle body, a latch and a pole assembled to a side of the door 100, or the like. In the latch state, the pole prohibits the latch engaged with the striker from rotating to prevent the door 100 which is closed from being opened. In the unlatch state, the pole permits the latch engaged with the striker to rotate to allow the door 100 to be opened.

Figure 4:
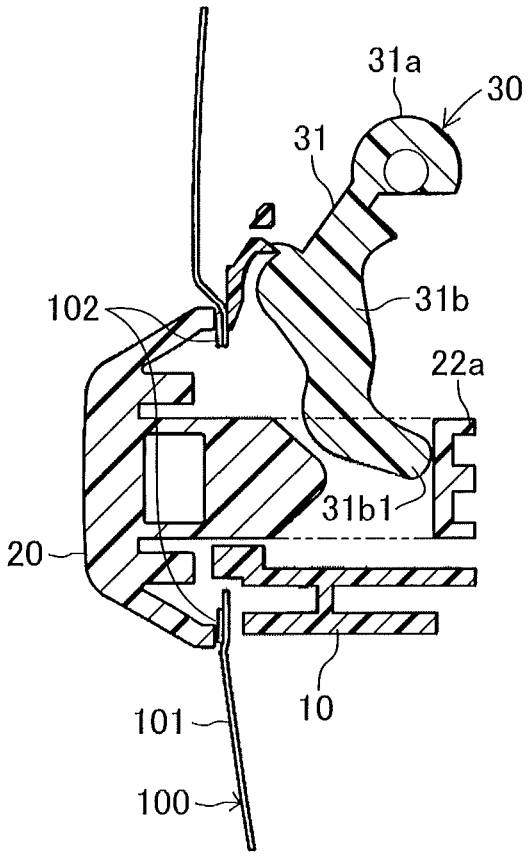
FIG. 4 is a vertical cross-sectional front view showing the base member, outer handle, and linkage mechanism or the like in the state shown in FIGS. 2 and 3 (in the set state).

As shown in FIG. 3, the bell crank 31 is rotatably assembled to the base member 10 at an axial portion 31*a* of the bell crank 31. The bell crank 31 comprises an input arm portion 31*b* and an output arm portion 31*c*. As shown in FIGS. 3 and 4, the input arm portion 31*b* extends downward in a radial direction of the axial portion 31*a* and is engaged (contacted) with an outside surface of the vehicle of the engaging portion 22*a* of the outer handle 20 at a tip 31*b*1 of the input arm portion 31*b* (see FIG. 4). The output arm portion 31*c* extends upward in the radial direction of the axial portion 31*a* and is connected to an upper end portion 33*b* of the connection lever 33 via a connection axis 33*a* integrally mounted to the connection lever 33. As shown in FIG. 3 by a dashed-two dotted line, it is possible to provide the output arm portion 31*c* with a counter weight portion (inertia portion) 31*d* extending along the axial portion 31*a*. Notably, the counter weight portion (inertia portion) 31*d* of the output arm portion 31*c* is for restraining the movement of the outer handle 20 for opening the door from occurring due to an inertia force that works toward the outer direction of the door 100 at the time of impact of the vehicle. A restraining force is set based on mass of the counter weight portion (inertia portion) 31*d* and a biasing force of the coil spring 32.

The coil spring 32 is a return spring (a structural member of a return mechanism which automatically returns the outer handle 20 to the door closed position from the door open position) biasing the bell crank 31 and the outer handle 20 toward a set position (door closed position) shown in FIGS. 2 to 4. The coil spring 32 is assembled to an outer circumference of the axial portion 31*a* of the bell crank 31. The coil spring 32 is engaged with the base member 10 at one end thereof and with the bell crank 31 at the other end thereof. The coil spring 32 biases the bell crank 31 in a rotatable direction (counterclockwise direction in FIG. 4) in which the tip 31*b*1 of the input arm portion 31*b* of the bell crank 31 engages with the engaging portion 22*a* of the outer handle 20. Owing to this, the tip 31*b*1 of the input arm portion 31*b* of the bell crank 31 is elastically engaged with the engaging portion 22*a* of the outer handle 20.

The connection lever 33 extends inside the door 100 in the upper and lower direction of the vehicle, and is tiltable in a width direction of the vehicle. The movement of the connection lever 33 in a lower direction of the vehicle corresponds to an operation in a direction for opening the door. As shown in FIG. 3, the connection lever 33 is connected to the output arm portion 31*c* of the bell crank 31 at an upper end portion 33*b* of the connection lever 33, and engaged, via the door-opened-prevention mechanism 40, with the connection pin 34 assembled to an outside open lever 61 (see FIGS. 1 and 3) that is linked with a pole (not shown in FIGS) of the door latch mechanism at a bifurcated lower end portion 33*c*. This connection lever 33 is configured to move downward by a predetermined amount from the set position (initial position) shown in FIGS. 2 and 3 when the outer handle 20 moves from the door closed position to the door open position and the bell crank 31 rotates by a predetermined amount against the biasing force of the coil spring 32. The door-opened-prevention mechanism 40 is assembled to the lower end portion 33*c* of the connection lever 33.

In the linkage mechanism 30, when the door 100 is closed, the outer handle 20 is in the door closed position. When the connection lever 33 is in the initial position, the door latch mechanism is in the latch state. When the outer handle 20 moves from the door closed position to the door open position and the connection lever 33 moves downward by a predetermined amount from the initial position, the door latch mechanism is made to be in the unlatch state. From the foregoing, the rotation of the bell crank 31 against the biasing force of the coil spring 32 and the movement downward of the connection lever 33 correspond to operations in a direction for opening the door.

Figure 5:
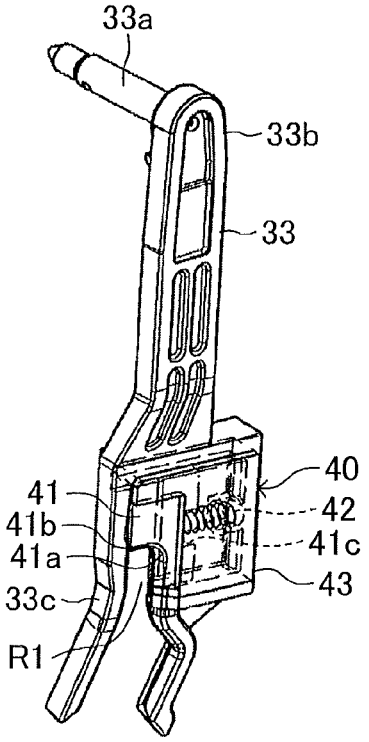
FIG. 5 is a perspective view showing the connection lever of the linkage mechanism and the door-opened-prevention mechanism assembled to the connection lever (in a state in which the lever member is in the set position), shown in FIG. 3.
Figure 6:
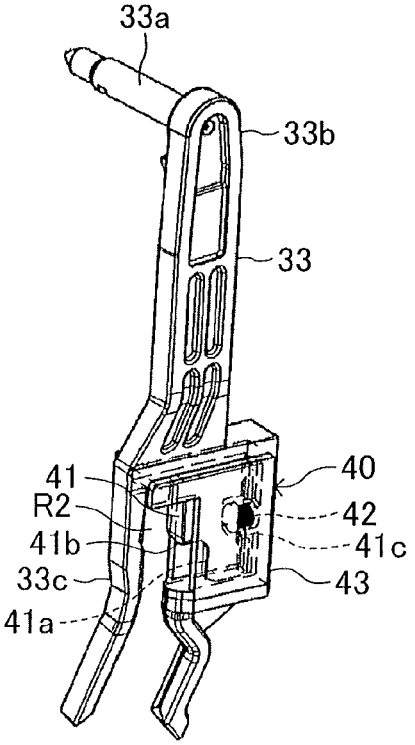
FIG. 6 is a perspective view showing the connection lever of the linkage mechanism and the door-opened-prevention mechanism assembled to the connection lever (in a state in which the lever member is in the fallback position), shown in FIG. 3.

The door-opened-prevention mechanism 40 does not enable a movement of the connection lever 33 (transmitting member) of the linkage mechanism 30 in a direction for opening the door, in response to the movement of the outer handle 20 for opening the door due to inertia force exerted on a lever member 41 toward the outer direction of the door 100 at the time of impact of the vehicle in a state in which the door 100 is closed, to be transmitted to the connection pin 34 (transmitted member) of the linkage mechanism 30, so as to prevent the door 100 from being opened. As shown in FIGS. 3, 5 and 6, this door-opened-prevention mechanism 40 comprises the lever member 41 assembled to the connection lever 33 by use of a case 43 above the connection pin 34, and a coil spring 42 assembled between the lever member 41 and the case 43.

As shown in FIGS. 5 and 6, the lever member 41 is of an almost rectangular shape, and is assembled in advance in the case 43 along with the coil spring 42 so that the lever member 41 is slidable relative to the case 43 in a width direction of the vehicle. The lever member 41 has a corner portion located at an inner side of the vehicle and at a lower side (a side close to the connection pin 34) where a first cutout 41*a* and a second cutout 41*b* are formed, and has a recess portion 41*c* for accommodating a spring at an outer side of the vehicle.

The first cutout 41*a* has a longitudinal wall and a lateral wall. When the lever member 41 is in a set position shown in FIGS. 3, 5, and 7, the first cutout 41*a* forms a space R1 for accommodating the connection pin 34 in collaboration with the lower end portion 33*c* of the connection lever 33. As shown in FIG. 3, the first cutout 41*a* also enables the movement of the connection lever 33 in the direction for opening the door (a lower direction in FIG. 3) to be transmitted to the connection pin 34 in a direction perpendicular to a biasing direction (a inside direction of the vehicle) of the coil spring 42 when the lever member 41 is in the set position.

The second cutout 41*b* is formed by chamfering an inside end portion of the vehicle of the lateral wall of the first cutout 41*a*. The second cutout 41*b* prevents the lever member 41 from engaging (interfering) with the connection pin 34 when the lever member 41 moves from the set position to a fallback position shown in FIGS. 6 and 8 to form a space R2 for the connection pin 34 to escape in collaboration with the lower end portion 33*c* of the connection lever 33. The recess portion 41*c* for accommodating a spring is formed in an intermediate portion in an upper and a lower direction of the lever member 41 at an outer side of the vehicle. The recess portion 41*c* is capable of accommodating an inside end portion of the vehicle of the coil spring 42.

The coil spring 42 is accommodated in the case 43. The coil spring 42 is engaged with the lever member 41 at one end thereof (an inside end of the vehicle) and is engaged with the case 43 at the other end thereof (an outside end of the vehicle). The coil spring 42 biases the lever member 41 with a predetermined biasing force toward an inside direction of the vehicle (the set position). By virtue of this, when the outer handle 20 moves from the door closed position to the door open position due to the inertia force exerted on the outer handle 20 at the time of impact of the vehicle, the lever member 41 is configured to move to the fallback position from the set position against the biasing force of the coil spring 42 by use of an inertia force exerted on the lever member 41, prior to the movement of the outer handle for opening the door (the movement from the door closed position to the door open position). The case 43 is made to be a sub-assembly along with the lever member 41 and the coil spring 42 or the like. The case 43 is assembled to the lower end portion 33*c* of the connection lever 33.

Figure 7:
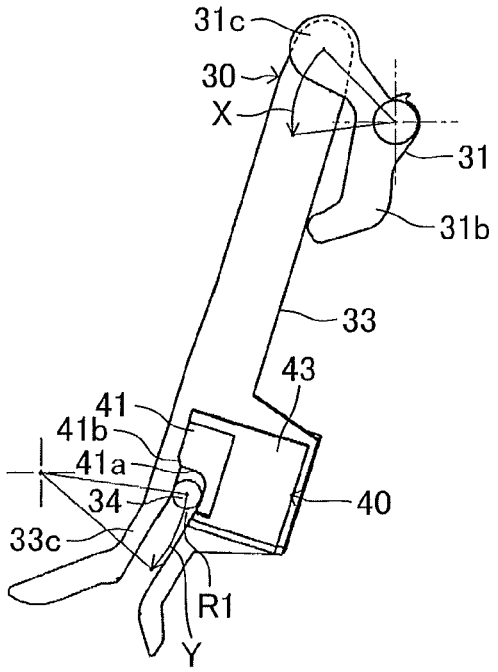
FIG. 7 is a schematic view for explaining an operation of the linkage mechanism when the lever member of the door-opened-prevention mechanism is in the set position.

In the embodiment configured according to the above, in normal condition (specifically the inertia force is not exerted toward the outer direction of the door 100 on the outer handle 20 or the like), as shown in FIGS. 3, 5, and 7, the lever member 41 of the door-opened-prevention mechanism 40 is kept to be in the set position so as to enable the necessary and sufficient movement of the connection lever 33 of the linkage mechanism 30 in the direction for opening the door in response to the movement of the outer handle 20 for opening the door to be transmitted to the connection pin 34 via the lever member 41. With this, a movement of the outer handle 20 for opening the door is transmitted to the door latch mechanism as an unlatch operation of the latch mechanism by the linkage mechanism 30 (specifically as shown in FIG. 7, an moving distance of the connection lever 33 shown by an arrow X is able to be transmitted to the connection pin 34 as a necessary and sufficient moving distance of the connection pin 34 shown by an arrow Y). Therefore, the movement of the outer handle 20 for opening the door enables the door 100 of the vehicle to be opened.

Figure 8:
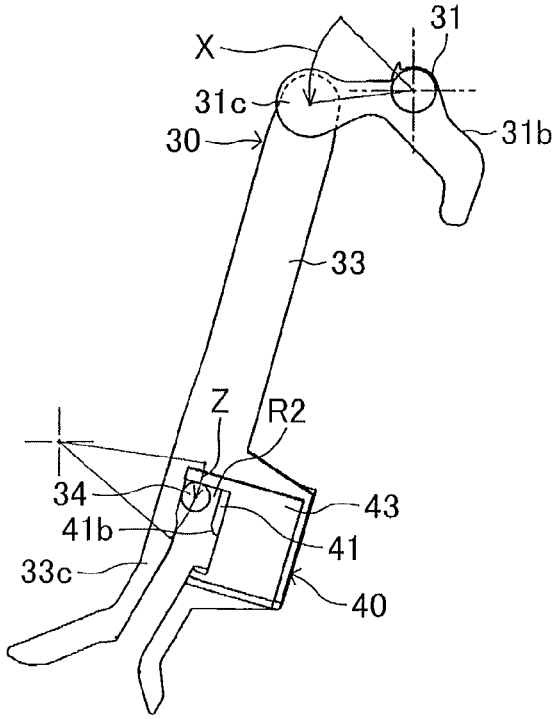
FIG. 8 is a schematic view for explaining an operation of the linkage mechanism when the lever member of the door-opened-prevention mechanism is in the fallback position.

Incidentally, at the time of impact of the vehicle (specifically in a condition where the inertia force is exerted on the outer handle 20 or the like), the lever member 41 of the door-opened-prevention mechanism 40 moves to the fallback position from the set position by use of an inertia force exerted on the lever member 41 against the biasing force of the coil spring 42 prior to the movement of the outer handle 20 for opening the door (see FIGS. 6 and 8). The necessary and sufficient movement of the connection lever 33 in the direction for opening the door in response to the movement of the outer handle 20 for opening the door is not able to be transmitted to the connection pin 34 via the lever member 41 (specifically as shown in FIG. 8, an moving distance of the connection lever 33 shown by an arrow X is able to be transmitted to the connection pin 34 as a moving distance of the connection pin 34 shown by an arrow Z and therefore a difference between the moving distance shown by an arrow Y in FIG. 7 and the moving distance shown by an arrow Z in FIG. 8 cannot be transmitted). Thus, at the time of impact of the vehicle, even if the movement of the outer handle 20 for opening the door occurs due to the inertia force, as shown in FIG. 8, a necessary and sufficient movement in the direction for opening is not transmitted in the linkage mechanism 30 so as to prevent the door latch mechanism from executing the unlatch operation (an operation for shifting the door latch mechanism from a state in which the door is kept to be closed (the latch state) to a state in which the door can be opened (the unlatch state)). Notably, the moving distance of the connection pin 34 shown by an arrow Z in FIG. 8 can be made to be zero, by setting the size of the lever member 41 appropriately (e.g. making the lever member 41 appropriately large).

Figure 9:
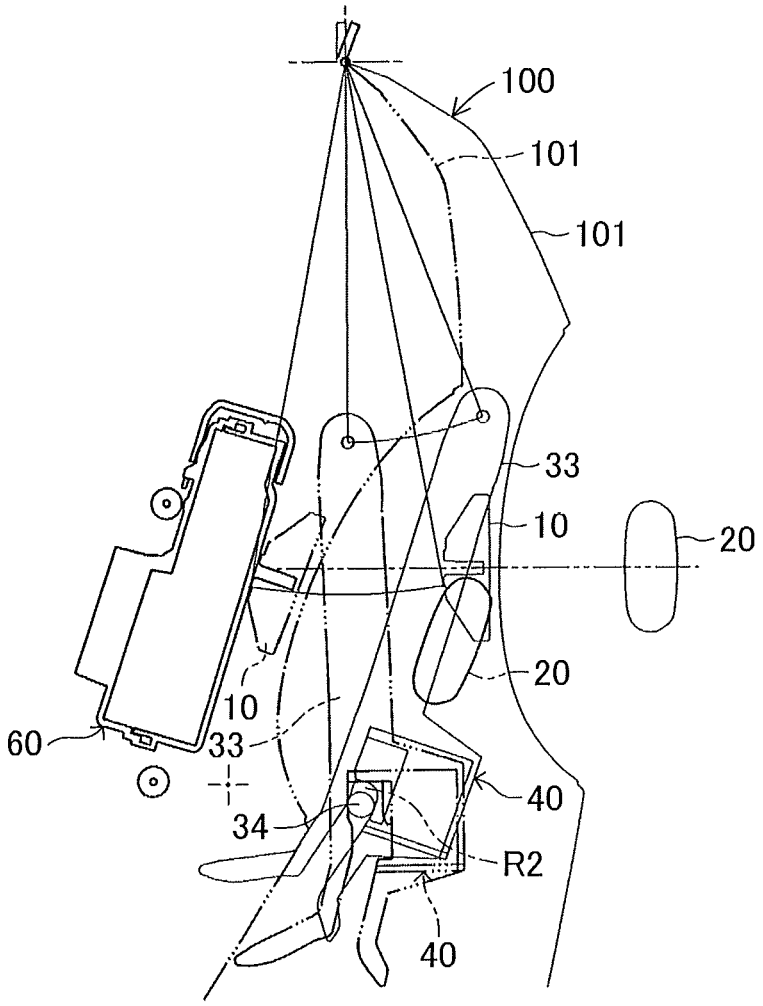
FIG. 9 is a schematic view for explaining an operation in a case where the door is deformed so that the base member, the outer handle, and the linkage mechanism or the like move closer in a width direction of the vehicle and downward relative to the door lock apparatus (including the door latch mechanism).

In this embodiment, at the time of impact of the vehicle, the lever member 41 of the door-opened-prevention mechanism 40, that is assembled to the connection lever 33 above the connection pin 34, moves to the fallback position from the set position against the biasing force of the coil spring 42 due to the inertia force prior to the movement of the outer handle 20 for opening the door. Therefore, the space R2 for the connection pin 34 to escape (a space for allowing the connection lever 33 to move freely downward relative to the connection pin 34) is formed above the connection pin 34. Accordingly, even in a case where, the door 100 is deformed so that the base member 10, the outer handle 20, and the linkage mechanism 30 or the like move closer in a width direction of the vehicle and downward relative to the door lock apparatus 60 including the door latch mechanism (specifically as shown in FIG. 9, even in a case where the base member 10, the outer handle 20, and the linkage mechanism 30 or the like is changed from a state shown in FIG. 9 with a solid line to a state shown in FIG. 9 with a dashed-two dotted line due to a deformation of the outer panel 101 at a portion adjacent to a B pillar of the door 100), the connection pin 34 is able to move freely relative to the connection lever 33 within the space R2 for the connection pin 34 to escape (is able to remain at an initial position of the connection pin 34). Therefore, the movements of the base member 10, the outer handle 20, and the linkage mechanism 30 or the like due to the deformation of the door is not capable of raising a necessary and sufficient operation for opening the door in the linkage mechanism 30 and therefore the door 100 is prevented from being opened.

In this embodiment, the lever member 41 and the coil spring 42 of the door-opened-prevention mechanism 40 are assembled to the connection lever 33 by use of the case 43 accommodating the lever member 41 and the coil spring 42. By virtue of this, the lever member 41 and the coil spring 42 may be preliminarily assembled to the case 43 to make them a sub-assembly. Accordingly, an ease for assembling the lever member 41 and the coil spring 42 or the like to the connection lever 33 can be obtained in a good manner.

In this embodiment, the first cutout 41*a* and the second cutout 41*b* are formed at the corner portion of the lever member 41 located at an inner and lower side of the vehicle. By virtue of this, when the lever member 41 is at the set position (see FIGS. 3, 5, and 7), the first cutout 41*a* is capable of ensuring a desired function of transmitting, and when the lever member 41 moves from the set position to the fallback position (see FIGS. 6 and 8), the second cutout 41*b* is capable of preventing the lever member 41 from engaging (interfering) with the connection pin 34 to ensure a favorable performance for the connection pin 34 to escape.

In the above-described embodiment, the door outer handle apparatus for a vehicle according to the present invention is applied to the door 100 assembled to the vehicle at a rear and right side. However, the door outer handle apparatus for a vehicle according to the present invention can be also applied to a door assembled to the vehicle at a rear and left side as well as doors assembled to the vehicle at a front and right side and at a front and left side in a same manner or with appropriate modifications. The door outer handle apparatus for a vehicle according to the present invention can be also applied to a door (back door) assembled to the vehicle at a rear end side in a same manner or with appropriate modifications.

The invention claimed is:

1. A door outer handle apparatus for a vehicle, said door outer handle apparatus comprising:

a base member fixed to a door of the vehicle;

an outer handle provided on the base member to swingably move relative to the base member in an inner and outer direction of the vehicle, the outer handle being movable between a door closed position and a door open position which is in an outer direction of the vehicle to the door closed position;

a linkage mechanism capable of transmitting a movement of the outer handle, from the door closed position to the door open position, to a door latch mechanism as an unlatch operation of the latch mechanism to open the door; and a door-opened-prevention mechanism not enabling a movement of a transmitting member of the linkage mechanism in a direction for opening the door, in response to the movement of the outer handle for opening the door due to inertia force exerted on the outer handle toward the outer direction of the vehicle at the time of impact of the vehicle, to be transmitted to a transmitted member of the linkage mechanism, so as to prevent the door from being opened, wherein the transmitting member of the linkage mechanism is a connection lever, and the door-opened-prevention mechanism comprises:

a lever member assembled to the transmitting member above the transmitted member, the lever member being movable between a set position and a fallback position which is in the outer direction of the vehicle to the set position;

a biasing member biasing the lever member toward the set position, wherein when the inertia force is not exerted on the outer handle, the lever member is kept to be in the set position so as to enable the necessary and sufficient movement of the transmitting member in the direction for opening the door in response to the movement of the outer handle for opening the door to be transmitted to the transmitted member via the lever member, and when the inertia force is exerted on the outer handle, the lever member moves to the fallback position from the set position against the biasing force of the biasing member prior to the movement of the outer handle for opening the door so as not to enable the necessary and sufficient movement of the transmitting member in the direction for opening the door in response to the movement of the outer handle for opening the door to be transmitted to the transmitted member via the lever member; and a case connected to the connection lever, the lever member and the biasing member being accommodated in the case.

2. A door outer handle apparatus according to claim 1, wherein the connection lever is positioned to extend inside the door in an upper and lower direction of the vehicle, and is tiltable in a width direction of the vehicle, a movement of the connection lever in a lower direction of the vehicle corresponds to the movement of the transmitting member in the direction for opening the door.

3. A door outer handle apparatus according to claim 1, wherein the lever member has a corner portion located at an inner side of the vehicle and at a side close to the transmitted member where a first and a second cutouts are formed, the first cutout forming a space for accommodating the transmitted member in collaboration with the transmitting member and enabling the movement of the transmitting member in the direction for opening the door to be transmitted to the transmitted member in a direction perpendicular to a biasing direction of the biasing member when the lever member is in the set position, and the second cutout preventing the lever member from engaging with the transmitted member when the lever member moves to the fallback position to form a space for the transmitted member to escape in collaboration with the transmitting member.

4. A door outer handle apparatus for a vehicle, said door outer handle apparatus comprising:

a base member fixed to a door of the vehicle;

an outer handle on the base member to swingably move relative to the base member in an inner and outer direction of the vehicle, the outer handle being movable in a first movement in the outer direction of the vehicle from a door closed position to a door open position;

a door latch mechanism configured to latch the door to prevent the door from opening;

a linkage mechanism configured to transmit the first movement of the outer handle to the door latch mechanism as an unlatch operation of the latch mechanism to open the door, the linkage mechanism comprising a transmitting member and a transmitted member;

a door-opened-prevention mechanism not enabling a movement of the transmitting member of the linkage mechanism in a direction for opening the door, in response to the movement of the outer handle for opening the door due to inertia force exerted on the outer handle toward the outer direction of the vehicle at the time of impact of the vehicle, to be transmitted to the transmitted member of the linkage mechanism, so as to prevent the door from being opened, the door-opened-prevention mechanism comprising a lever member and a spring biasing the lever member towards the set position, the spring possessing a central axis;

the lever member being connected to the transmitting member above the transmitted member, the lever member being movable between a set position and a fallback position which is in the outer direction of the vehicle to the set position; and wherein when the inertia force is not exerted on the outer handle, the lever member is kept in the set position to enable movement of the transmitting member in the direction for opening the door in response to the movement of the outer handle for opening the door to be transmitted to the transmitted member via the lever member, and when the inertia force is exerted on the outer handle, the lever member axially moves parallel to the central axis of the spring to the fallback position from the set position against the biasing force of the spring prior to the movement of the outer handle for opening the door so as not to enable the necessary and sufficient movement of the transmitting member in the direction for opening the door in response to the movement of the outer handle for opening the door to be transmitted to the transmitted member via the lever member.

5. The door outer handle apparatus according to claim 4, wherein the transmitting member is positioned inside the door and extends in an upper and lower direction of the vehicle, and is tiltable in a width direction of the vehicle, such that a movement of the transmitting member in a lower direction of the vehicle corresponds to the direction for opening the door.

6. A door outer handle apparatus according to claim 4, wherein the lever member has a corner portion located at an inner side of the vehicle and at a side close to the transmitted member where a first cutout and a second cutout are formed, the first cutout forming a space for accommodating the transmitted member in collaboration with the transmitting member and enabling the movement of the transmitting member in the direction for opening the door to be transmitted to the transmitted member in a direction perpendicular to a biasing direction of the spring when the lever member is in the set position, and the second cutout preventing the lever member from engaging with the transmitted member when the lever member moves to the fallback position to form a space for the transmitted member to escape in collaboration with the transmitting member.

7. A door outer handle apparatus according to claim 4, wherein the lever member has a corner portion located at an inner side of the vehicle and at a side close to the transmitted member where a first cutout and a second cutout are formed, the first cutout forming a space for accommodating the transmitted member in collaboration with the transmitting member and enabling the movement of the transmitting member in the direction for opening the door to be transmitted to the transmitted member in a direction perpendicular to a biasing direction of the compression spring when the lever member is in the set position, and the second cutout preventing the lever member from engaging with the transmitted member when the lever member moves to the fallback position to form a space for the transmitted member to escape in collaboration with the transmitting member.

8. A door outer handle apparatus for a vehicle, said door outer handle apparatus comprising:

a base member fixed to a door of the vehicle;

an outer handle on the base member to swingably move relative to the base member in an inner and outer direction of the vehicle, the outer handle being movable in a first movement in the outer direction of the vehicle from a door closed position to a door open position;

a door latch mechanism configured to latch the door to prevent the door from opening;

a linkage mechanism configured to transmit the first movement of the outer handle to the door latch mechanism as an unlatch operation of the latch mechanism to open the door, the linkage mechanism comprising a transmitting member and a transmitted member;

a door-opened-prevention mechanism not enabling a movement of the transmitting member of the linkage mechanism in a direction for opening the door, in response to the movement of the outer handle for opening the door due to inertia force exerted on the outer handle toward the outer direction of the vehicle at the time of impact of the vehicle, to be transmitted to the transmitted member of the linkage mechanism, so as to prevent the door from being opened, the door-opened-prevention mechanism comprising a lever member and a compression spring configured to apply a biasing force to the lever member to bias the lever member towards the set position;

the lever member being connected to the transmitting member above the transmitted member, the lever member being movable between a set position and a fallback position which is in the outer direction of the vehicle to the set position; and wherein when the inertia force is not exerted on the outer handle, the lever member is kept in the set position to enable movement of the transmitting member in the direction for opening the door in response to the movement of the outer handle for opening the door to be transmitted to the transmitted member via the lever member, and when the inertia force is exerted on the outer handle, the lever member moves to the fallback position from the set position against the biasing force of the compression spring to axially compress the compression spring prior to the movement of the outer handle for opening the door so as not to enable the necessary and sufficient movement of the transmitting member in the direction for opening the door in response to the movement of the outer handle for opening the door to be transmitted to the transmitted member via the lever member.

9. The door outer handle apparatus according to claim 8, wherein the transmitting member is positioned inside the door and extends in an upper and lower direction of the vehicle, and is tiltable in a width direction of the vehicle, such that a movement of the transmitting member in a lower direction of the vehicle corresponds to the direction for opening the door.

* * * * *